US009004323B2

(12) United States Patent
Greer, Jr.

(10) Patent No.: US 9,004,323 B2
(45) **Date of Patent: *Apr. 14, 2015**

(54) AEROSOL SYSTEMS AND METHODS FOR DISPENSING TEXTURE MATERIAL

(71) Applicant: Homax Products, Inc., Bellingham, WA (US)

(72) Inventor: Lester R. Greer, Jr., Seattle, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/147,474

(22) Filed: Jan. 3, 2014

(65) Prior Publication Data

US 2014/0120260 A1 May 1, 2014

Related U.S. Application Data

(63) Continuation of application No. 13/466,989, filed on May 8, 2012, now Pat. No. 8,622,255, which is a continuation of application No. 12/873,121, filed on Aug. 31, 2010, now Pat. No. 8,172,113, which is a (Continued)

(51) Int. Cl.
*B65D 83/00* (2006.01)
*E04B 1/84* (2006.01)
(Continued)

(52) U.S. Cl.
CPC . *E04B 1/84* (2013.01); *B65D 83/30* (2013.01); *B65D 83/306* (2013.01); *B65D 83/48* (2013.01); *E04F 13/02* (2013.01); *E04F 21/12* (2013.01); *B65D 83/68* (2013.01)

(58) Field of Classification Search
USPC ..... 222/1, 394, 402.1, 402.18, 222/402.21–402.25; 239/337, 340, 592, 239/597; 521/50, 78, 178
See application file for complete search history.

(56) References Cited

U.S. PATENT DOCUMENTS 208,330 A 9/1878 Palmer
351,968 A 11/1886 Derrick
(Continued)

FOREIGN PATENT DOCUMENTS

CA 770467 10/1967
CA 976125 10/1975
(Continued)

OTHER PUBLICATIONS

ATSM, "Standard Test Method for Conducting Cyclic Potentiodynamic Polarization Measurements for Localized Corrosion Susceptibility of Iron-Nickel, or Cobalt-Based Alloys," 1993, 5 pages.

(Continued)

*Primary Examiner* — Frederick C Nicolas
(74) *Attorney, Agent, or Firm* — Michael R. Schacht

(57) ABSTRACT

A system for forming an acoustic texture coating on a surface, the system having an aerosol dispenser, a liquid portion of a propellant material, a gas portion of the propellant material, a base material, and a plurality of discrete particles of at least one of urethane foam and melamine foam, where the discrete particles define a physical structure. The liquid portion of the propellant material, the gas portion of the propellant material, the base material, and the plurality of discrete particles are disposed within the aerosol dispenser. The propellant material does not alter the physical structure of the discrete particles when combined within the aerosol dispenser. When the aerosol dispenser is operated, the base material and the discrete particles are deposited on an uncoated portion of the surface such that the base material dries to adhere the discrete particles to the uncoated portion of the surface.

8 Claims, 6 Drawing Sheets

Related U.S. Application Data continuation of application No. 12/368,960, filed on Feb. 10, 2009, now Pat. No. 7,784,649, which is a continuation of application No. 11/413,659, filed on Apr. 27, 2006, now Pat. No. 7,487,893, and a continuation-in-part of application No. 11/027,219, filed on Dec. 29, 2004, now Pat. No. 7,374,068.

(60) Provisional application No. 60/675,697, filed on Apr. 27, 2005, provisional application No. 60/617,236, filed on Oct. 8, 2004.

(51) Int. Cl.

| | |
|---|---|
| ***B65D 83/30*** | (2006.01) |
| ***B65D 83/48*** | (2006.01) |
| ***E04F 13/02*** | (2006.01) |
| ***E04F 21/12*** | (2006.01) |
| ***B65D 83/68*** | (2006.01) |

(56) References Cited

U.S. PATENT DOCUMENTS

| | | | |
|---|---|---|---|
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,486,156 | A | 3/1924 | Needham |
| 2,127,188 | A | 8/1938 | Schellin et al. |
| 2,149,930 | A | 3/1939 | Plastaras |
| D134,562 | S | 12/1942 | Murphy |
| 2,307,014 | A | 1/1943 | Becker et al. |
| 2,320,964 | A | 6/1943 | Yates |
| 2,353,318 | A | 7/1944 | Scheller |
| 2,388,093 | A | 10/1945 | Smith |
| 2,530,808 | A | 11/1950 | Cerasi |
| 2,565,954 | A | 8/1951 | Dey |
| 2,612,293 | A | 9/1952 | Michel |
| 2,686,652 | A | 8/1954 | Carlson et al. |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,831,618 | A | 4/1958 | Soffer et al. |
| 2,839,225 | A | 6/1958 | Soffer et al. |
| 2,908,446 | A | 10/1959 | Strouse |
| 2,932,434 | A | 4/1960 | Abplanalp |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 3,083,872 | A | 4/1963 | Meshberg |
| 3,107,059 | A | 10/1963 | Frechette |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,216,628 | A | 11/1965 | Fergusson |
| 3,246,850 | A | 4/1966 | Bourke |
| 3,258,208 | A | 6/1966 | Greenebaum, II |
| 3,284,007 | A | 11/1966 | Clapp |
| 3,314,571 | A | 4/1967 | Greenebaum |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford |
| 3,405,845 | A | 10/1968 | Cook et al. |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,513,886 | A | 5/1970 | Easter et al. |
| 3,514,042 | A | 5/1970 | Freed |
| 3,544,258 | A | 12/1970 | Presant et al. |
| 3,548,564 | A | 12/1970 | Bruce et al. |
| 3,550,861 | A | 12/1970 | Teson |
| 3,575,319 | A | 4/1971 | Safianoff |
| 3,592,359 | A | 7/1971 | Marraffino |
| 3,596,835 | A | 8/1971 | Smith |
| 3,608,822 | A | 9/1971 | Berthoud |
| 3,613,954 | A | 10/1971 | Bayne |
| 3,648,932 | A | 3/1972 | Ewald et al. |
| 3,653,558 | A | 4/1972 | Shay |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,705,669 | A | 12/1972 | Cox et al. |
| 3,711,030 | A | 1/1973 | Jones |
| 3,764,067 | A | 10/1973 | Coffey et al. |
| 3,770,166 | A | 11/1973 | Marand |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,891,128 | A | 6/1975 | Smrt |
| 3,912,132 | A | 10/1975 | Stevens |
| 3,913,803 | A | 10/1975 | Laauwe |
| 3,913,804 | A | 10/1975 | Laauwe |
| 3,913,842 | A | 10/1975 | Singer |
| 3,932,973 | A | 1/1976 | Moore |
| 3,936,002 | A | 2/1976 | Geberth, Jr. |
| 3,938,708 | A | 2/1976 | Burger |
| 3,975,554 | A | 8/1976 | Kummins et al. |
| 3,982,698 | A | 9/1976 | Anderson |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,673 | A | 7/1977 | Murphy et al. |
| 4,045,860 | A | 9/1977 | Winckler |
| 4,089,443 | A | 5/1978 | Zrinyi |
| 4,096,974 | A | 6/1978 | Haber et al. |
| 4,117,951 | A | 10/1978 | Winckler |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,164,492 | A | 8/1979 | Cooper |
| RE30,093 | E | 9/1979 | Burger |
| 4,171,757 | A | 10/1979 | Diamond |
| 4,173,558 | A | 11/1979 | Beck |
| 4,185,758 | A | 1/1980 | Giggard |
| 4,187,959 | A | 2/1980 | Pelton |
| 4,187,985 | A | 2/1980 | Goth |
| 4,198,365 | A | 4/1980 | Pelton |

(56) References Cited

U.S. PATENT DOCUMENTS

| | | | |
|---|---|---|---|
| 4,202,470 | A | 5/1980 | Fujii |
| 4,238,264 | A | 12/1980 | Pelton |
| 4,240,940 | A | 12/1980 | Vasishth et al. |
| 4,258,141 | A | 3/1981 | Jarre et al. |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |
| 4,346,743 | A | 8/1982 | Miller |
| 4,354,638 | A | 10/1982 | Weinstein |
| 4,358,388 | A | 11/1982 | Daniel et al. |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,438,221 | A | 3/1984 | Fracalossi et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |
| 4,546,905 | A | 10/1985 | Nandagiri et al. |
| 4,595,127 | A | 6/1986 | Stoody |
| 4,609,608 | A | 9/1986 | Solc |
| 4,641,765 | A | 2/1987 | Diamond |
| 4,683,246 | A | 7/1987 | Davis et al. |
| 4,702,400 | A | 10/1987 | Corbett |
| 4,728,007 | A | 3/1988 | Samuelson et al. |
| 4,744,495 | A | 5/1988 | Warby |
| 4,761,312 | A | 8/1988 | Koshi et al. |
| 4,792,062 | A | 12/1988 | Goncalves |
| 4,793,162 | A | 12/1988 | Emmons |
| 4,804,144 | A | 2/1989 | Denman |
| 4,815,414 | A | 3/1989 | Duffy et al. |
| 4,819,838 | A | 4/1989 | Hart, Jr. |
| 4,830,224 | A | 5/1989 | Brison |
| 4,839,393 | A | 6/1989 | Buchanan et al. |
| 4,854,482 | A | 8/1989 | Bergner |
| 4,870,805 | A | 10/1989 | Morane |
| 4,878,599 | A | 11/1989 | Greenway |
| 4,887,651 | A | 12/1989 | Santiago |
| 4,893,730 | A | 1/1990 | Bolduc |
| 4,896,832 | A | 1/1990 | Howlett |
| D307,649 | S | 5/1990 | Henry |
| 4,940,171 | A | 7/1990 | Gilroy |
| 4,949,871 | A | 8/1990 | Flanner |
| 4,953,759 | A | 9/1990 | Schmidt |
| 4,954,544 | A | 9/1990 | Chandaria |
| 4,955,545 | A | 9/1990 | Stern et al. |
| 4,961,537 | A | 10/1990 | Stern |
| 4,969,577 | A | 11/1990 | Werding |
| 4,969,579 | A | 11/1990 | Behar |
| 4,988,017 | A | 1/1991 | Schrader et al. |
| 4,991,750 | A | 2/1991 | Moral |
| 5,007,556 | A | 4/1991 | Lover |
| 5,009,390 | A | 4/1991 | McAuliffe, Jr. et al. |
| 5,037,011 | A | 8/1991 | Woods |
| 5,038,964 | A | 8/1991 | Bouix |
| 5,052,585 | A | 10/1991 | Bolduc |
| 5,059,187 | A | 10/1991 | Sperry et al. |
| 5,065,900 | A | 11/1991 | Scheindel |
| 5,069,390 | A | 12/1991 | Stern et al. |
| 5,083,685 | A | 1/1992 | Amemiya et al. |
| 5,100,055 | A | 3/1992 | Rokitenetz et al. |
| 5,115,944 | A | 5/1992 | Nikolich |
| 5,126,086 | A | 6/1992 | Stoffel |
| 5,169,037 | A | 12/1992 | Davies et al. |
| 5,182,316 | A | 1/1993 | DeVoe et al. |
| 5,188,263 | A | 2/1993 | Woods |
| 5,188,295 | A | 2/1993 | Stern et al. |
| 5,211,317 | A | 5/1993 | Diamond et al. |
| 5,219,609 | A | 6/1993 | Owens |
| 5,250,599 | A | 10/1993 | Swartz |
| 5,277,336 | A | 1/1994 | Youel |
| 5,297,704 | A | 3/1994 | Stollmeyer |
| 5,307,964 | A | 5/1994 | Toth |
| 5,310,095 | A | 5/1994 | Stern et al. |
| 5,312,888 | A | 5/1994 | Nafziger et al. |
| 5,314,097 | A | 5/1994 | Smrt et al. |
| 5,323,963 | A | 6/1994 | Ballu |
| 5,341,970 | A | 8/1994 | Woods |
| 5,342,597 | A | 8/1994 | Tunison, III |
| 5,368,207 | A | 11/1994 | Cruysberghs |
| 5,374,434 | A | 12/1994 | Clapp et al. |
| 5,405,051 | A | 4/1995 | Miskell |
| 5,409,148 | A | 4/1995 | Stern et al. |
| 5,417,357 | A | 5/1995 | Yquel |
| D358,989 | S | 6/1995 | Woods |
| 5,421,519 | A | 6/1995 | Woods |
| 5,425,824 | A | 6/1995 | Marwick |
| 5,450,983 | A | 9/1995 | Stern et al. |
| 5,467,902 | A | 11/1995 | Yquel |
| 5,476,879 | A | 12/1995 | Woods et al. |
| 5,489,048 | A | 2/1996 | Stern et al. |
| 5,498,282 | A | 3/1996 | Miller et al. |
| 5,501,375 | A | 3/1996 | Nilson |
| 5,505,344 | A | 4/1996 | Woods |
| 5,523,798 | A | 6/1996 | Hagino |
| 5,524,798 | A | 6/1996 | Stern et al. |
| 5,544,783 | A | 8/1996 | Conigliaro |
| 5,548,010 | A | 8/1996 | Franer |
| 5,549,228 | A | 8/1996 | Brown |
| 5,558,247 | A | 9/1996 | Caso |
| 5,562,235 | A | 10/1996 | Cruysberghs |
| 5,570,813 | A | 11/1996 | Clark, II |
| 5,573,137 | A | 11/1996 | Pauls |
| 5,583,178 | A | 12/1996 | Oxman et al. |
| 5,597,095 | A | 1/1997 | Ferrara, Jr. |
| 5,615,804 | A | 4/1997 | Brown |
| 5,639,026 | A | 6/1997 | Woods |
| 5,641,095 | A | 6/1997 | de Laforcade |
| 5,645,198 | A | 7/1997 | Stern et al. |
| 5,655,691 | A | 8/1997 | Stern et al. |
| 5,695,788 | A | 12/1997 | Woods |
| 5,715,975 | A | 2/1998 | Stern et al. |
| 5,727,736 | A | 3/1998 | Tryon |
| 5,752,631 | A | 5/1998 | Yabuno et al. |
| 5,775,432 | A | 7/1998 | Burns et al. |
| 5,792,465 | A | 8/1998 | Hagarty |
| 5,799,879 | A | 9/1998 | Ottl et al. |
| 5,865,351 | A | 2/1999 | De Laforcade |
| 5,868,286 | A | 2/1999 | Mascitelli |
| 5,887,756 | A | 3/1999 | Brown |
| 5,894,964 | A | 4/1999 | Barnes et al. |
| 5,915,598 | A | 6/1999 | Yazawa et al. |
| 5,921,446 | A | 7/1999 | Stern |
| 5,934,518 | A | 8/1999 | Stern et al. |
| 5,941,462 | A | 8/1999 | Sandor |
| 5,957,333 | A | 9/1999 | Losenno et al. |
| 5,975,356 | A | 11/1999 | Yquel et al. |
| 5,988,575 | A | 11/1999 | Lesko |
| 6,000,583 | A | 12/1999 | Stern et al. |
| 6,027,042 | A | 2/2000 | Smith |
| 6,032,830 | A | 3/2000 | Brown |
| 6,039,306 | A | 3/2000 | Pericard et al. |
| 6,062,494 | A | 5/2000 | Mills |
| 6,070,770 | A | 6/2000 | Tada et al. |
| 6,092,698 | A | 7/2000 | Bayer |
| 6,095,435 | A | 8/2000 | Greer, Jr. et al. |
| 6,112,945 | A | 9/2000 | Woods |
| 6,113,070 | A | 9/2000 | Holzboog |
| 6,116,473 | A | 9/2000 | Stern et al. |
| 6,129,247 | A | 10/2000 | Thomas et al. |
| 6,131,777 | A | 10/2000 | Warby |
| 6,139,821 | A | 10/2000 | Fuerst et al. |
| 6,152,335 | A | 11/2000 | Stern et al. |
| 6,161,735 | A | 12/2000 | Uchiyama et al. |
| 6,168,093 | B1 | 1/2001 | Greer, Jr. et al. |
| 6,170,717 | B1 | 1/2001 | Di Giovanni et al. |
| D438,111 | S | 2/2001 | Woods |
| 6,225,393 | B1 | 5/2001 | Woods |
| 6,254,015 | B1 | 7/2001 | Abplanalp |

(56) References Cited

U.S. PATENT DOCUMENTS

| | | | |
|---|---|---|---|
| 6,257,503 | B1 | 7/2001 | Baudin |
| 6,261,631 | B1 | 7/2001 | Lomasney et al. |
| 6,265,459 | B1 | 7/2001 | Mahoney et al. |
| 6,276,570 | B1 | 8/2001 | Stern et al. |
| 6,283,171 | B1 | 9/2001 | Blake |
| 6,284,077 | B1 | 9/2001 | Lucas et al. |
| 6,290,104 | B1 | 9/2001 | Bougamont et al. |
| 6,291,536 | B1 | 9/2001 | Taylor |
| 6,296,155 | B1 | 10/2001 | Smith |
| 6,296,156 | B1 | 10/2001 | Lasserre et al. |
| 6,299,679 | B1 | 10/2001 | Montoya |
| 6,299,686 | B1 | 10/2001 | Mills |
| 6,315,152 | B1 | 11/2001 | Kalisz |
| 6,325,256 | B1 | 12/2001 | Liljeqvist et al. |
| 6,328,185 | B1 | 12/2001 | Stern et al. |
| 6,328,197 | B1 | 12/2001 | Gapihan |
| 6,333,365 | B1 | 12/2001 | Lucas et al. |
| 6,352,184 | B1 | 3/2002 | Stern et al. |
| 6,362,302 | B1 | 3/2002 | Boddie |
| 6,375,036 | B1 | 4/2002 | Woods |
| 6,382,474 | B1 | 5/2002 | Woods et al. |
| 6,386,402 | B1 | 5/2002 | Woods |
| 6,394,321 | B1 | 5/2002 | Bayer |
| 6,394,364 | B1 | 5/2002 | Abplanalp |
| 6,395,794 | B2 | 5/2002 | Lucas et al. |
| 6,398,082 | B2 | 6/2002 | Clark et al. |
| 6,399,687 | B2 | 6/2002 | Woods |
| 6,414,044 | B2 | 7/2002 | Taylor |
| 6,415,964 | B2 | 7/2002 | Woods |
| 6,439,430 | B1 | 8/2002 | Gilroy, Sr. et al. |
| 6,446,842 | B2 | 9/2002 | Stern et al. |
| D464,395 | S | 10/2002 | Huang |
| 6,474,513 | B2 | 11/2002 | Burt |
| 6,478,198 | B2 | 11/2002 | Haroian |
| 6,478,561 | B2 | 11/2002 | Braun et al. |
| 6,482,392 | B1 | 11/2002 | Zhou et al. |
| D468,980 | S | 1/2003 | Woods |
| 6,510,969 | B2 | 1/2003 | Di Giovanni et al. |
| 6,520,377 | B2 | 2/2003 | Yquel |
| 6,531,528 | B1 | 3/2003 | Kurp |
| 6,536,633 | B2 | 3/2003 | Stern et al. |
| 6,581,807 | B1 | 6/2003 | Mekata |
| 6,588,628 | B2 | 7/2003 | Abplanalp et al. |
| 6,595,393 | B1 | 7/2003 | Loghman-Adham et al. |
| 6,613,186 | B2 | 9/2003 | Johnson |
| 6,615,827 | B2 | 9/2003 | Greenwood et al. |
| 6,637,627 | B1 | 10/2003 | Liljeqvist et al. |
| 6,641,005 | B1 | 11/2003 | Stern et al. |
| 6,641,864 | B2 | 11/2003 | Woods |
| 6,652,704 | B2 | 11/2003 | Green |
| 6,659,312 | B1 | 12/2003 | Stern et al. |
| 6,666,352 | B1 | 12/2003 | Woods |
| 6,688,492 | B2 | 2/2004 | Jaworski et al. |
| 6,712,238 | B1 | 3/2004 | Mills |
| 6,726,066 | B2 | 4/2004 | Woods |
| 6,736,288 | B1 | 5/2004 | Green |
| 6,758,373 | B2 | 7/2004 | Jackson et al. |
| 6,797,051 | B2 | 9/2004 | Woods |
| 6,802,461 | B2 | 10/2004 | Schneider |
| 6,831,110 | B2 | 12/2004 | Ingold et al. |
| 6,832,704 | B2 | 12/2004 | Smith |
| 6,843,392 | B1 | 1/2005 | Walker |
| 6,848,601 | B2 | 2/2005 | Greer, Jr. |
| 6,851,575 | B2 | 2/2005 | van't Hoff |
| 6,880,733 | B2 | 4/2005 | Park |
| 6,913,407 | B2 | 7/2005 | Greer et al. |
| 6,926,178 | B1 | 8/2005 | Anderson |
| 6,966,467 | B2 | 11/2005 | Di Giovanni et al. |
| 6,971,553 | B2 | 12/2005 | Brennan et al. |
| 6,981,616 | B2 | 1/2006 | Loghman-Adham et al. |
| 7,374,068 | B2 * | 5/2008 | Greer, Jr. ..... 222/402.1 |
| 7,487,893 | B1 * | 2/2009 | Greer et al. ..... 222/402.1 |
| 7,784,649 | B2 | 8/2010 | Greer, Jr. |
| 7,947,753 | B2 | 5/2011 | Greer, Jr. |
| 8,042,713 | B2 | 10/2011 | Greer, Jr. |
| 8,172,113 | B2 | 5/2012 | Greer, Jr. |
| 8,251,255 | B1 | 8/2012 | Greer, Jr. et al. |
| 8,336,742 | B2 | 12/2012 | Greer, Jr. et al. |
| 8,420,705 | B2 | 4/2013 | Greer, Jr. |
| 8,622,255 | B2 * | 1/2014 | Greer, Jr. ..... 222/402.1 |
| 2002/0003147 | A1 | 1/2002 | Corba |
| 2002/0100769 | A1 | 8/2002 | McKune |
| 2003/0134973 | A1 | 7/2003 | Chen et al. |
| 2003/0205580 | A1 | 11/2003 | Yahav |
| 2004/0141797 | A1 | 7/2004 | Garabedian et al. |
| 2004/0157960 | A1 | 8/2004 | Rowe |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2224042 | 6/1999 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CH | 680849 | 11/1992 |
| DE | 210449 | 5/1909 |
| DE | 1926796 | 3/1970 |
| DE | 3808438 | 4/1989 |
| DE | 3806991 | 9/1989 |
| FR | 463476 | 2/1914 |
| FR | 84727 | 9/1965 |
| FR | 1586067 | 2/1970 |
| FR | 2659847 | 9/1991 |
| GB | 867713 | 5/1961 |
| GB | 970766 | 9/1964 |
| GB | 977860 | 12/1964 |
| GB | 1144385 | 3/1969 |
| JP | 461392 | 1/1971 |
| JP | 55142073 | 11/1980 |
| JP | 8332414 | 12/1996 |
| WO | 9418094 | 8/1994 |

OTHER PUBLICATIONS

Chadwick, "Controlling Particle Size in Self-Pressurized Aerosol Packages," Metal Finishing Jul./Aug. 2004 vol. 102 No. 7/8, 3 pages.

Homax Products, Inc., "Easy Touch Spray Texture Brochure", Mar. 1992, 1 page.

Newman-Green, Inc., "Aerosol Valves, Sprayheads & Accessories Catalog", Apr. 1, 1992, pp. 14, 20, and 22.

TAIT, "An Introduction to Electrochemical Corrosion Testing for Practicing Engineers and Scientists," 1994, 17 pages.

* cited by examiner

AEROSOL SYSTEMS AND METHODS FOR DISPENSING TEXTURE MATERIAL

RELATED APPLICATIONS

This application, U.S. patent application Ser. No. 14/147,474 filed Jan. 3, 2014 is a continuation of U.S. patent application Ser. No. 13/466,989 filed May 8, 2012, now U.S. Pat. No. 8,622,255, which issued on Jan. 7, 2014.

U.S. patent application Ser. No. 13,466,989 is a continuation of U.S. patent application Ser. No. 12/873,121 filed Aug. 31, 2010, now U.S. Pat. No. 8,172,113, which issued May 8, 2012.

U.S. patent application Ser. No. 12/873,121 is a continuation of U.S. patent application Ser. No. 12/368,960 filed Feb. 10, 2009, now U.S. Pat. No. 7,784,649, which issued Aug. 31, 2010.

U.S. patent application Ser. No. 12/368,960 is a continuation of U.S. patent application Ser. No. 11/413,659 filed Apr. 27, 2006, now U.S. Pat. No. 7,487,893, which issued Feb. 10, 2009.

U.S. patent application Ser. No. 11/413,659 claims benefit of U.S. Provisional Patent Application Ser. No. 60/675,697 filed Apr. 27, 2005.

U.S. patent application Ser. No. 11/413,659 is also a continuation-in-part of U.S. patent application Ser. No. 11/027,219 filed Dec. 29, 2004, now U.S. Pat. No. 7,374,068, which issued May 20, 2008.

U.S. patent application Ser. No. 11/027,219 claims benefit of U.S. Provisional Patent Application Ser. No. 60/617,236 filed Oct. 8, 2004.

The contents of all related applications listed above are incorporated herein by reference.

TECHNICAL FIELD

The present invention relates to the art of repairing a textured surface and, more particularly, to dispensing systems and methods for depositing texture materials, such as acoustic texture material and stucco material, onto a portion of a textured surface to be repaired.

BACKGROUND

In some situations, a separate texture layer is applied to an interior or external surface, often prior to painting. The texture layer is typically formed by spraying texture material onto the surface. Texture material is a coating material that, when sprayed, does not form a smooth, thin coating. Instead, texture material is applied in or contains discrete drops, globs, or particles that dry to form a bumpy, irregular textured surface.

Texture materials can be applied using any one of a number of application systems. During new construction, texture materials are commonly applied in a stream of compressed air using commercial hopper gun systems. For touch up or repair, texture material is commonly applied using hand operated pneumatic pumps or aerosol dispensing systems. Varying the parameters of the application system varies the size and spacing of the bumps to vary the look of the textured surface.

One specific form of texture material is commonly referred to as "acoustic" or "popcorn" texture material. In addition to a coating material, acoustic texture material further comprises an aggregate material. When the acoustic texture material is applied using commercial hopper guns, the aggregate material is conventionally formed by polystyrene chips.

However, as will be described in detail below, chips made of polystyrene foam are dissolved by hydrocarbon aerosol propellant materials.

Accordingly, aerosol dispensing systems for dispensing small amounts of acoustic texture material for repair or touch-up purposes use one of two approaches. The first approach is to mix a liquid hydrocarbon aerosol propellant material with chips made from materials other than polystyrene. However, when chips made of materials other than polystyrene foam are used, the appearance and function of the texture surface may be different from that of the surrounding surface.

The second approach is to combine polystyrene chips with a propellant material formed by a pressurized inert gas such as nitrogen or air. This second approach allows the use of a conventional acoustic texture material including polystyrene chips. However, the use of a pressurized inert gas causes the acoustic texture material to be dispensed very quickly. The use of pressurized inert gas as a propellant can make it difficult for a non-professional to control the application of the acoustic texture material.

A second form of texture material is commonly referred to as "stucco." Conventionally, stucco is a plaster material made of Portland cement, sand, and lime. Conventional stucco is applied while soft to vertical walls or surfaces and then allowed to dry to form a decorative and protective coating. More recently, stucco surfaces have been formed using synthetic materials designed to resemble traditional stucco. Synthetic stucco is formed by acrylic polymers that, when dry, are flexible and water impervious. The term "stucco" will be used herein to refer both to traditional cement-based materials and to synthetic materials that resemble the traditional material.

Stucco material can be damaged and should be repaired for both structural and aesthetic reasons. Non-professionals typically do not have the tools or materials to repair a damage stucco surface to match the look of the original stucco surface surrounding the patch.

The need thus exists for systems and methods for dispensing texture materials, such as acoustic texture materials and stucco materials, that facilitate the repair by non-professionals of damaged surfaces to match the original texture material surrounding the patched area.

RELATED ART

Various aerosol devices for spraying a coating material onto a wall surface, ceiling, or the like are known. Depending upon the composition of the coating material, and other factors, the coating material can be sprayed onto the surface in a variety of texture patterns.

In some instances, a somewhat roughened texture is achieved by utilizing a textured composition that forms into droplets when it is dispensed, with the material then hardening with these droplets providing the textured surface. In other instances, solid particulate material is mixed with the liquid texture material so that with the particulate material being deposited with the hardenable liquid material on the wall surface, these particles provide the textured surface.

In particular, the Applicants are aware of prior art spray texture devices using an aerosol container which contains the texture material mixed with a propellant under pressure and from which the textured material is discharged onto a surface. Such aerosol dispensers are commonly used when there is a relatively small surface area to be covered with the spray texture material. Two such spray texture devices are disclosed in U.S. Pat. No. 5,037,011, issued Aug. 6, 1991, and more recently U.S. Pat. No. 5,188,263, issued Feb. 23, 1993 with John R. Woods being named inventor of both of these patents.

Additionally, the Assignee of the present invention has since approximately 1983 manufactured and sold manually operated devices for applying spray texture material onto walls and ceilings. These spray texture devices are described in one or more of the following U.S. Pat. Nos. 4,411,387; 4,955,545; 5,069,390; 5,188,295. These spray texture devices comprised a hopper containing hardenable material, a manually operated pump, and a nozzle. By pointing the device at the area being patched and operating the manual pump, the hardenable material and pressurized air generated by the pump were mixed in the nozzle and subsequently sprayed onto the area being patched.

However, the Applicant is unaware of any existing aerosol spray texture devices capable of dispensing small quantities of texture materials, such as acoustic texture material or stucco material, for the purpose of repairing a damaged surface.

SUMMARY

The present invention may also be embodied as a method of forming an acoustic texture coating on a surface comprising the following steps. An aerosol dispenser is provided. A liquid portion of a propellant material, a gas portion of the propellant material, a base material, and a plurality of discrete particles are arranged within the aerosol dispenser. The discrete particles are at least one of urethane foam and melamine foam. The discrete particles define a physical structure, and the propellant material does not alter the physical structure of the discrete particles when the propellant material and the discrete particles are arranged within the aerosol dispenser. The aerosol dispenser is operated to deposit the base material and the particles on the surface. The base material is allowed to dry to adhere the discrete particles to the surface.

DETAILED DESCRIPTION

I. Aerosol Stucco Dispensing Systems

Figure 1:
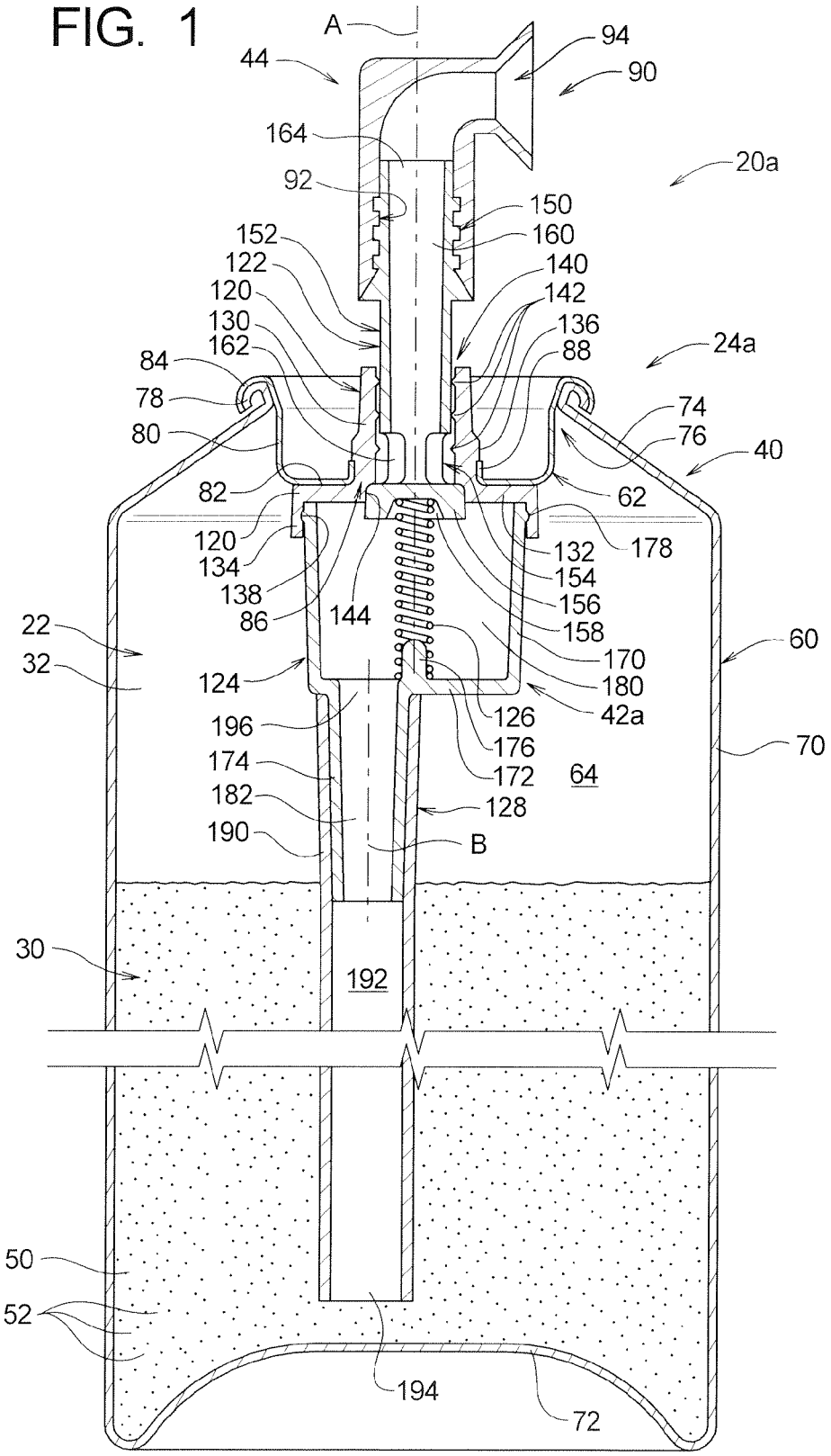
FIG. 1 is a cut-away, side elevation view of a first example mechanical system of the present invention.
Figure 2:
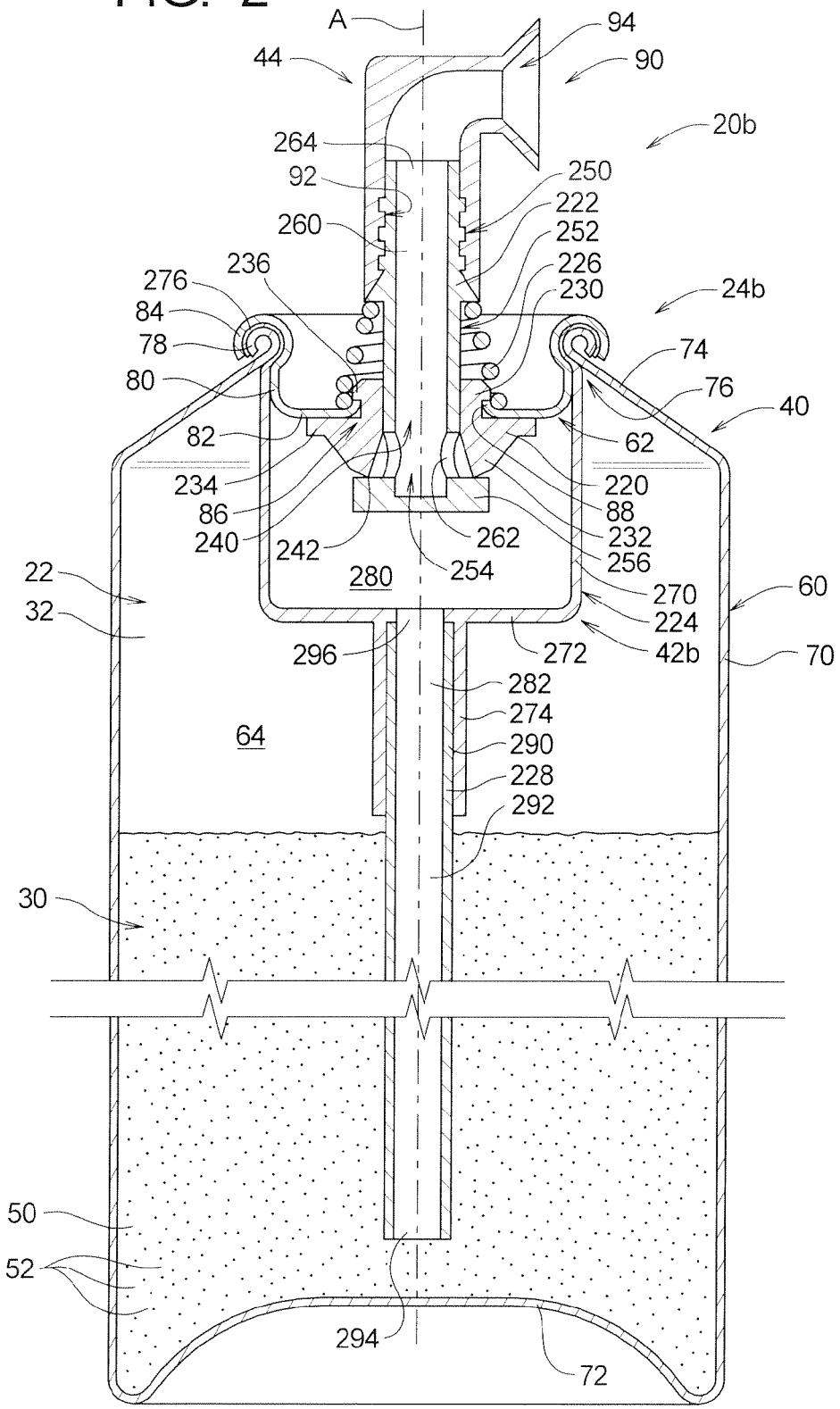
FIG. 2 is a cut-away, side elevation view of a second example mechanical system of the present invention.

Depicted in FIGS. 1 and 2 of the drawing are first and second examples of an aerosol stucco dispensing systems 20*a* and 20*b* constructed in accordance with, and embodying, the principles of the present invention. In the following discussion and the drawing, the appendices "a" and "b" will be used to refer to features unique to the first and second example texturing systems 20*a* and 20*b*, respectively.

The example aerosol stucco dispensing systems 20*a* and 20*b* comprise a fluid system 22 and a mechanical system 24*a*, 24*b*. The fluid system 22 comprises a stucco material 30 to be dispensed and a propellant material 32. The mechanical systems 24*a* and 24*b* comprise a container assembly 440, an actuator 44, and a valve assembly 42*a* and 42*b*, respectively. For clarity in FIGS. 1 and 2, the stucco material 30 is shown only in the container assembly 440; as will be described in further detail below, the texture material will also forced into the valve assembly 42*a*, 42*b* and, in some situations, through and out the actuator 44.

The container assemblies 440 and actuator 44 of the example mechanical systems 24*a* and 24*b* are or may be the substantially the same and will be described only once below. The valve assemblies 42*a* and 42*b* differ and will each be described separately below.

In use, the stucco material 30 and propellant material 32 are stored within the container assembly 440. The propellant material 32 pressurizes the stucco material 30. The valve assembly 42*a*, 42*b* is normally in a closed state, and depressing the actuator 44 causes the valve assembly 42*a*, 42*b* to be placed into an open state. When the valve assembly 42*a*, 42*b* is in the open state, the pressurized propellant material 32 forces the stucco material 30 out of the container assembly 440 and onto a target surface to be coated.

The example stucco material 30 comprises a coating portion 50 and a particulate portion 52. The coating portion 50 exists in a liquid state when stored in the air-tight container assembly 440 but hardens when exposed to the air. The coating portion 50 is not per se important to any particular implementation of the present invention.

The particulate portion 52 is formed by small chips or particles of irregular shape but relatively consistent volume. The example particulate portion 52 is formed by sand, perlite, vermiculite, polypropylene, polyethylene.

As mentioned above, the propellant material 32 must be compatible with the material or materials forming the particulate portion 52 of the stucco material 30. As used herein, the term "compatible" refers to the lack of chemical or biological interaction between the propellant material 32 and the particulate portion 52 that would substantially permanently alter the physical structure or appearance of the particulate portion 52.

Referring now to the composition of the propellant material 32, one or more of the following materials may be used to form the example propellant material 32: DME; hydrocarbons such as propane and butane and any combinations of propane and butane; compressed air; and compressed nitrogen.

The propellant material 32 used by the example aerosol system 20 is formed by DME. When DME is used as the propellant material 32, the propellant material 32 exists partly in a liquid phase that is mixed with the stucco material 30 and partly in a gas phase that pressurizes the stucco material 30.

As the stucco material 30 is forced out of the container assembly 440, the pressure within the container assembly 440 drops. This pressure drop causes more of the liquid phase propellant material 32 to gasify. Once the actuator 44 is released and the valve assembly 42 returns to its closed state, the gas phase propellant material 32 continues to gasify until the stucco material 30 within the container assembly 440 is again pressurized. The use of DME as the propellant material 32 pressurizes the stucco material 30 at a relatively constant, relatively low level that allows the controlled dispensing of the stucco material 30.

Inert, compressed gasses, such as air or nitrogen, may be used as the propellant material 32. A propellant 32 formed of compressed inert gasses pressurizes the container to force the stucco material 30 out of the container assembly 440. To accommodate expansion of the compressed inert gasses, the system 20 is typically charged to a relatively high initial pressure.

Given the foregoing basic understanding of the example aerosol stucco dispensing systems 20*a* and 20*b*, the details of the systems 20*a* and 20*b* will now be described below in further detail.

A. Coating Portion

The coating portion 50 of the stucco material 30 forming part of the fluid system 22 may be conventional and typically includes the following components: binder such as acrylic polymer, emulsifier such as ester alcohol, filler such as calcium carbonate, water, biocide, fungicide, anti-freeze such as propylene glycol.

B. Container Assembly and Actuator

Referring now to FIGS. 1 and 2, the container assembly 40 and actuator 44 of the example mechanical systems 24*a* and 24*b* will now be described in detail. The example container assemblies 40 each comprises a container 60 and a cap 62. The cap 62 is attached to the container 60 to define a main chamber 64.

The container 60 is a metal body that comprises a side wall 70, lower wall 72, and upper wall 74. The upper wall 74 defines a cap opening 76 and an inner lip 78. The inner lip 78 extends around the cap opening 76. The cap 62 is also a metal body that comprises an extension wall 80, a base wall 82, and an outer lip 84. The base wall 82 defines a mounting opening 86 and a mounting wall 88. The mounting wall 88 extends around the mounting opening 86.

To form the container assembly 40, the outer lip 84 of the cap 62 is arranged over the inner lip 78 of the container 60. The outer lip 84 is crimped such that the outer lip 84 engages, directly or indirectly, the inner lip 78. The resulting container assembly 40 defines a relatively rigid structure. In addition, the outer lip 84 and inner lip 78 engage each other, directly or indirectly, to form a substantially fluid-tight seal; once the container assembly 40 is formed, fluid may flow into and out of the main chamber 64 only through the mounting opening 86. In the example system 20*a*, the outer lip 84 directly engages the inner lip 78. As will be described in further detail below, the outer lip 84 indirectly engages the inner lip 78 in the example system 20*b*.

The container assembly 40 as described is relatively conventional, and container assemblies of different construction may be used in place of the example container assembly 40 depicted in FIGS. 1 and 2.

The example actuator 44 is a plastic body defining an actuator passageway 90. The actuator passageway 90 comprises a threaded portion 92 and an outlet portion 94. As will be described in further detail below, the threaded portion 92 is adapted to engage the valve assemblies 42*a* and 42*b*. The example outlet portion 94 is frustoconical, but other shapes may be used instead or in addition. The example actuator passageway 90 turns along an angle of approximately 90 degrees, but the actuator passageway 90 may be straight or turn along an angle other than 90 degrees.

The actuator 44 as described is also relatively conventional, and actuators of different construction may be used in place of the example actuator 44 depicted in FIGS. 1 and 2.

C. First Example Valve Assembly

Referring now specifically to FIG. 1, the first example valve assembly 42*a* will now be described in further detail. The valve assembly 42*a* comprises a valve seat 120, a valve stem 122, a valve housing 124, a valve spring 126, and a collection tube 128.

The example valve seat 120 comprises a support portion 130, a seat portion 132, and a wall portion 134. Extending from the support portion 130 is a retaining projection 136, and formed in the wall portion 134 is a retaining recess 138. In addition, the valve seat 120 defines a stem opening 140 that extends from the seat portion 132 and through the support portion 130. Extending from the support portion 130 into the stem opening 140 are a plurality of support projections 142. A seat surface 144 is formed in the seat portion 132 around the stem opening 140.

The valve stem 122 comprises a threaded portion 150, a guide portion 152, an inlet portion 154, and a stop portion 156. A spring cavity 158 is formed in the stop portion 156. The valve stem 122 further comprises a stem passageway 160 defining a stem inlet 162 and a stem outlet 164. The stem inlet 162 is formed in the inlet portion 154 of the valve stem 122, and the stem outlet 164 is formed adjacent to the threaded portion 150 of the stem 122.

The valve housing 124 comprises a side wall 170, a bottom wall 172, a tube projection 174, and a spring projection 176. A mounting projection 178 extends from the side wall 170. The valve housing 124 defines a valve chamber 180, and a housing inlet passageway 182 extends through the tube projection 174 to allow fluid to flow into the valve chamber 180.

The housing inlet passageway 182 defines a housing inlet axis B. In the example valve assembly 42, the housing inlet axis B is parallel to and offset from the valve axis A. Other configurations may be used, but offsetting the housing inlet axis B from the valve axis A allows the spring projection 176 to be aligned with the valve axis A. The spring 126 itself thus may be aligned with the valve axis A.

The collection tube 128 comprises a side wall 190 and defines a tube passageway 192. The tube passageway 192 defines a tube inlet 194 and a tube outlet 196.

The valve assembly 42*a* is formed generally as follows. The following assembly steps may be performed in different sequences, and the following discussion does not indicate a preferred or necessary sequence of assembly steps.

The valve stem 122 is arranged such that the guide portion 152 thereof is received within the stem opening 140. The geometry of the example valve stem 122 requires a two-piece construction that would allow the relatively wide threaded portion 150 to be attached to the relatively wide stop portion 156 after the guide portion 152 has been arranged within the stem opening 140. If the threaded portion 150 is relatively narrow and can be inserted through the stem opening 140, the valve stem 122 may be made of a single-piece construction. As another alternative, the threaded portion 150 may be eliminated; in this case, the actuator 44 is secured to the valve stem 122 by other means such as friction and/or the use of an adhesive.

The valve spring 126 is arranged such that one end thereof is retained by the spring projection 176 on the bottom wall 172 of the valve housing 124. The valve housing 124 is displaced until the mounting projection 178 on the housing side wall 170 is received by the retaining recess 138 on the wall portion 134 of the valve seat 120. The other end of the spring 126 is received by the spring cavity 158 in the valve seat 120.

The support projections 142 on the support portion 130 of the valve seat 120 engage the guide portion 152 of the valve stem 122 to restrict movement of the valve stem 122 within a predetermined range along a valve axis A. The valve spring 126 resiliently opposes movement of the valve stem 122 towards the bottom wall 172 of the valve housing 124.

The valve seat 120 is displaced such that the support portion 130 extends through the mounting opening 86 in the cap 62. Further displacement of the valve seat 120 forces the retaining projection 136 on the valve seat 120 past the mounting wall 88 on the cap 62. The retaining projection 136 engages the mounting wall 88 to mechanically attach the valve seat 120 onto the cap 62. The overlap of the mounting wall 88 and base wall 82 with the valve seat 120 forms a substantially fluid-tight seal around the mounting opening 86.

The collection tube 128 is secured to the valve housing 124 by inserting the tube 128 into the housing inlet passageway 182 or, as shown in FIG. 1, inserting the tube projection 174 into the tube passageway 192.

The actuator 44 is attached to the valve stem 122. In particular, in the example mechanical system 24*a*, the threaded portions 92 and 150 engage each other to detachably attach the actuator 44 to the valve stem 122. As generally discussed above, other attachment systems may be used to attach the actuator 44 to the valve stem 122.

The valve assembly 42*a* operates basically as follows. The valve spring 126 biases the valve stem 122 into an extended position as shown in FIG. 1. When the valve stem 122 is in the extended position, the stop portion 156 thereof engages the seat surface 144 formed on the valve seat 120. The example seat surface 144 is annular and curved. The stop portion 156 is sized and configured to conform to the shape of the seat surface 144.

Accordingly, when the stop portion 156 of the valve stem engages the seat surface 144, fluid flow between the valve chamber 180 and the stem passageway 160 is substantially prevented, and the valve assembly 42*a* is in its closed position. However, by applying a force on the actuator 44 sufficient to compress the valve spring 126, the stop portion 156 is displaced away from the seat surface 144 to place the valve assembly 42*a* into its open configuration. When the valve assembly 42*a* is in its open configuration, fluid may flow between the valve chamber 180 and the stem passageway 160.

When fitted with the first example valve assembly 42*a*, the aerosol stucco dispensing system 20*a* is used to dispense stucco material 30 as follows. The actuator 44 is aimed towards a target surface and depressed towards the cap member 62 to place the valve assembly 42*a* in its open configuration. The propellant material 32 forces the stucco material 30 through the tube inlet 194, the tube passageway 192, the tube outlet 196, and the housing inlet 182 and into the valve chamber 180.

From the valve chamber 180, the stucco material 30 flows between the stop portion 156 and the seat surface 144 and into the stem inlet 162. The stucco material 30 then flows through the stem passageway 160 and out of the stem outlet 164. The stucco material 30 then flows along the actuator passageway 90 and out of the outlet portion 94 thereof. The stucco material 30 discharged through the outlet portion 94 forms a spray and ultimately lands on the target surface.

When sufficient stucco material 30 has been deposited onto the target surface, the force on the actuator 44 is released. The valve spring 126 displaces the valve stem 122 to place the valve assembly 42*a* back into its closed configuration. The stucco material 30 thus no longer flows out of the valve chamber 180 through the stem passageway 160.

D. Second Example Valve Assembly

Referring now specifically to FIG. 2, the second example valve assembly 42*b* will now be described in further detail. The valve assembly 42*b* comprises a valve seat 220, a valve stem 222, a valve housing 224, a valve spring 226, and a collection tube 228.

The example valve seat 220 comprises a support portion 230, a seat portion 232, and a wall portion 234. Extending from the support portion 230 is a retaining projection 236. In addition, the valve seat 220 defines a stem opening 240 that extends from the seat portion 232 and through the support portion 230. A seat edge 242 is formed in the seat portion 232 around the stem opening 240.

The valve stem 222 comprises a threaded portion 250, a guide portion 252, an inlet portion 254, and a stop portion 256. The valve stem 222 further comprises a stem passageway 260 defining a stem inlet 262 and a stem outlet 264. The stem inlet 262 is formed in the inlet portion 254 of the valve stem 222, and the stem outlet 264 is formed adjacent to the threaded portion 250 of the stem 222.

The valve housing 224 comprises a side wall 270, a bottom wall 272, and a tube projection 274. A mounting portion 276 extends from the side wall 270. The valve housing 224 defines a valve chamber 280, and a housing inlet passageway 282 extends through the tube projection 274 to allow fluid to flow into the valve chamber 280.

The collection tube 228 comprises a side wall 290 and defines a tube passageway 292. The tube passageway 292 defines a tube inlet 294 and a tube outlet 296.

The valve assembly 42*b* is formed generally as follows. The following assembly steps may be performed in different sequences, and the following discussion does not indicate a preferred or necessary sequence of assembly steps.

The valve stem 222 is arranged such that the guide portion 252 thereof is received within the stem opening 240. The geometry of the example valve stem 222 requires a two-piece construction that would allow the relatively wide threaded portion 250 to be attached to the relatively wide stop portion 256 after the guide portion 252 has been arranged within the stem opening 240. If the threaded portion 250 is relatively narrow and can be inserted through the stem opening 240, the valve stem 222 may be made of a single-piece construction. As another alternative, the threaded portion 250 may be eliminated; in this case, the actuator 44 is secured to the valve stem 222 by other means such as friction and/or the use of an adhesive.

The valve spring 226 is arranged such that one end thereof is supported by the base wall 82 of the cap 62. The other end of the spring 226 is arranged below the actuator 44 such that depressing the actuator 44 towards the container assembly 40 compresses the spring 226.

The support portion 230 of the valve seat 220 engages the guide portion 252 of the valve stem 222 to restrict movement of the valve stem 222 within a predetermined range along a valve axis A. The valve spring 226 resiliently opposes movement of the valve stem 222 towards the bottom wall 272 of the valve housing 224.

The valve seat 220 is displaced such that the support portion 230 extends through the mounting opening 86 in the cap 62. Further displacement of the valve seat 220 forces the retaining projection 236 on the valve seat 220 past the mounting wall 88 on the cap 62. The retaining projection 236 engages the mounting wall 88 to mechanically attach the valve seat 220 onto the cap 62. The overlap of the mounting wall 88 and base wall 82 with the valve seat 220 forms a substantially fluid-tight seal around the mounting opening 86.

The collection tube 228 is secured to the valve housing 224 by inserting the tube projection 274 into the tube passageway 292 or, as shown in FIG. 2, inserting the collection tube 228 at least partly into the housing inlet passageway 282.

The actuator 44 is attached to the valve stem 222. In particular, in the example mechanical system 24*b*, the threaded portions 92 and 250 engage each other to detachably attach the actuator 44 to the valve stem 222. As generally discussed above, other attachment systems may be used to attach the actuator 44 to the valve stem 222.

The valve assembly 42*b* operates basically as follows. The valve spring 226 biases the valve stem 222 into an extended position as shown in FIG. 2. When the valve stem 222 is in the extended position, the stop portion 256 thereof engages the seat edge 242 formed on the valve seat 220. When the stop portion 256 of the valve stem engages the seat edge 242, fluid flow between the valve chamber 280 and the stem passageway 260 is substantially prevented, and the valve assembly 42*b* is in its closed position.

However, by applying a force on the actuator 44 sufficient to compress the valve spring 226, the stop portion 256 is displaced away from the seat edge 242 to place the valve assembly 42*b* into its open configuration. When the valve assembly 42*b* is in its open configuration, fluid may flow between the housing chamber 280 and the stem passageway 260.

When fitted with the first example valve assembly 42*b*, the aerosol stucco dispensing system 20*b* is used to dispense stucco material 30 as follows. The actuator 44 is aimed towards a target surface and depressed towards the cap member 62 to place the valve assembly 42*b* in its open configuration. The propellant material 32 forces the stucco material 30 through the tube inlet 294, the tube passageway 292, the tube outlet 296, and the housing inlet 282 and into the housing chamber 280.

From the valve chamber 280, the stucco material 30 flows between the stop portion 256 and the seat edge 242 and into the stem inlet 262. The stucco material 30 then flows through the stem passageway 260 and out of the stem outlet 264. The stucco material 30 then flows along the actuator passageway 90 and out of the outlet portion 94 thereof. The stucco material 30 discharged through the outlet portion 94 forms a spray and ultimately lands on the target surface.

When sufficient stucco material 30 has been deposited onto the target surface, the force on the actuator 44 is released. The valve spring 226 displaces the valve stem 222 to place the valve assembly 42*b* back into its closed configuration. The stucco material 30 thus no longer flows out of the valve chamber 280 through the stem passageway 260.

E. Method of Use

Figure 3:
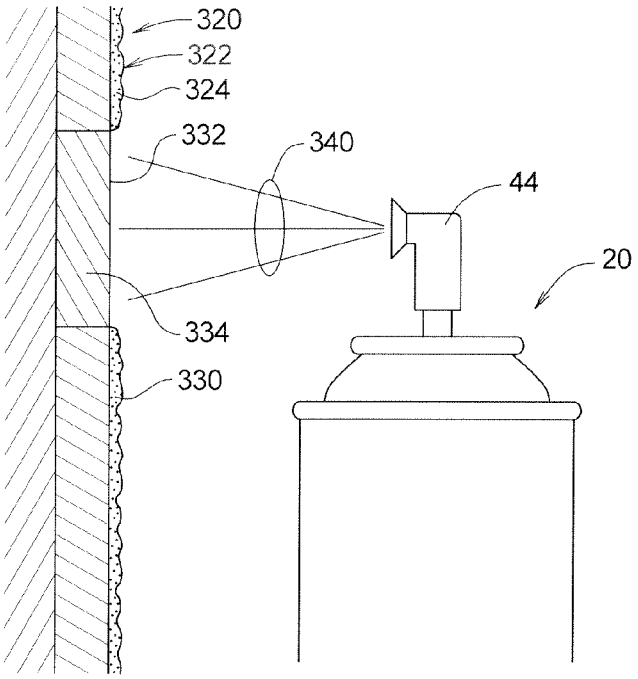
FIGS. 3 and 4 are side elevation partial cut-away views depicting a method of use of the example dispensing systems of the present invention.
Figure 4:
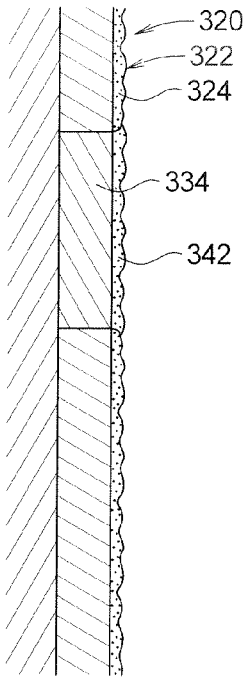

Referring now to FIGS. 3-6, the method of using the example aerosol stucco dispensing systems 20*a* and 20*b* will now be described in further detail. In FIG. 3, reference character 20 is used to refer to either of the dispensing systems 20*a* and 20*b* as described above.

Figure 5:
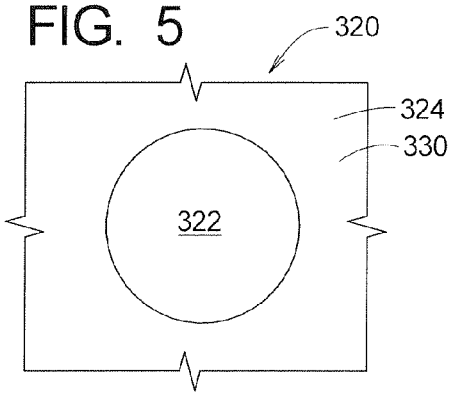
FIGS. 5 and 6 are front plan views depicting a portion of a wall structure under repair using the example dispensing systems of the present invention.

As shown in FIGS. 3 and 5, a wall structure 320 defines a wall surface 322 at least partly coated with a layer of pre-existing stucco material 324. The example wall surface 322 defines a coated portion 330 and an uncoated portion 332. The uncoated portion 332 may be formed where a patch 334 has been made in the wall structure, but the dispensing system 20 of the present invention can be used to dispense stucco material 30 in other environments.

The dispensing system 20 is arranged such that the outlet portion 94 of the actuator passageway 90 defined by the actuator 44 is generally directed towards the uncoated portion 320 as shown in FIG. 3. The actuator 44 is then depressed to cause the dispensing system 20 to dispense the stucco material 30 in a spray 340. The stucco material 30 is then allowed to dry and harden.

Figure 6:
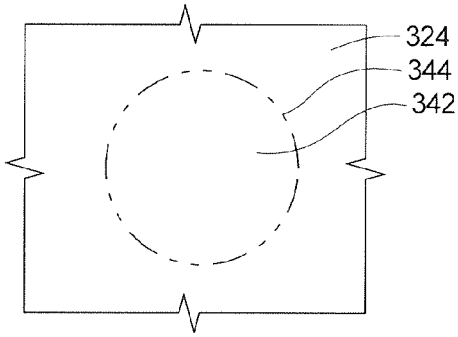

The spray 340 causes the stucco material 30 to be deposited onto the uncoated portion 332 in a thin layer 342 (FIG. 4) that substantially matches the pre-existing layer 324. A broken line 344 in FIG. 6 illustrates where the uncoated portion 332 was located prior to application of the stucco material 30.

II. Aerosol Acoustic Texture Dispensing Systems

Figure 7:
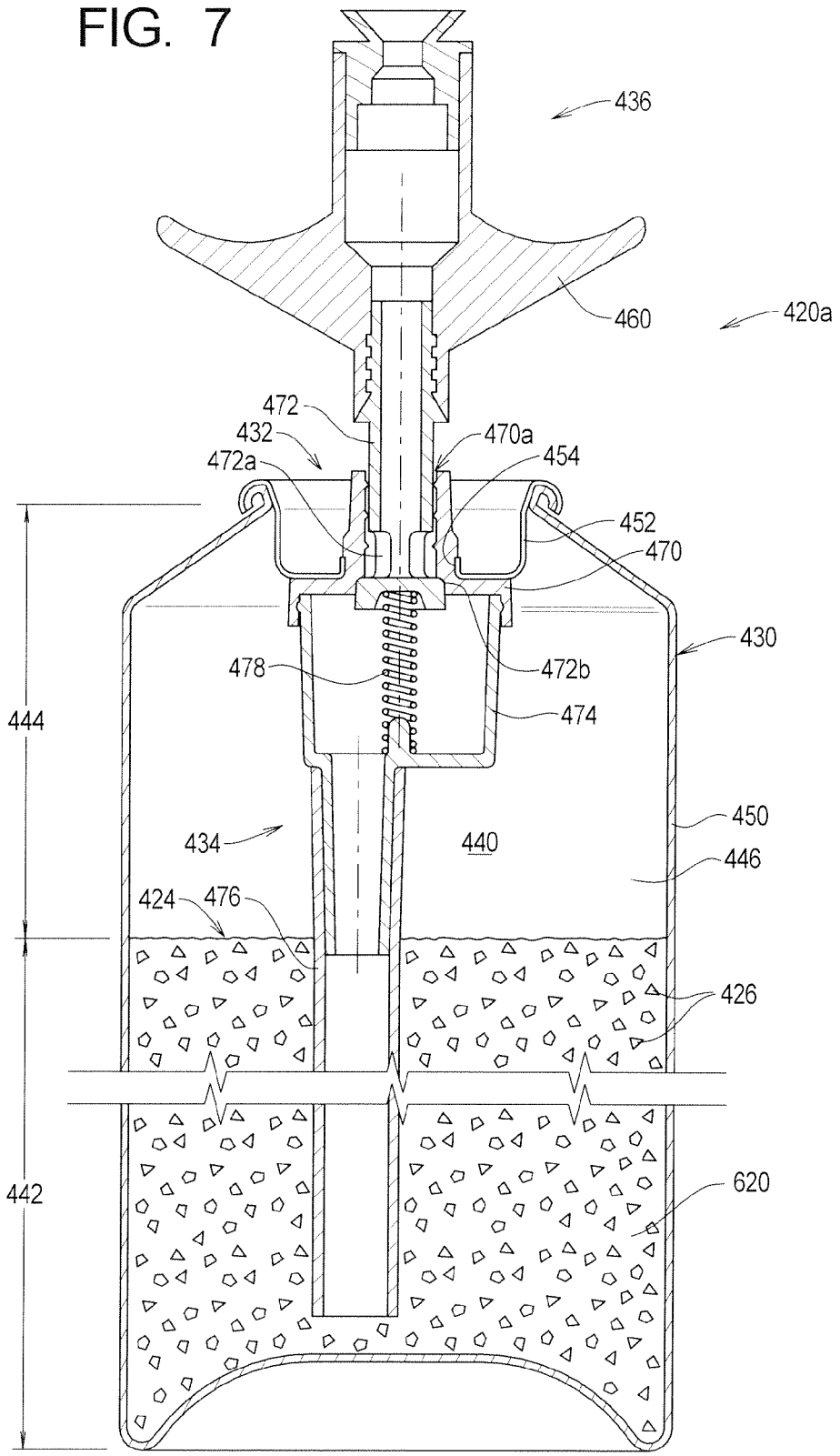
FIG. 7 is a section view of a first embodiment of an aerosol dispensing system containing acoustic texture material incorporating particulate material of the present invention.
Figure 8:
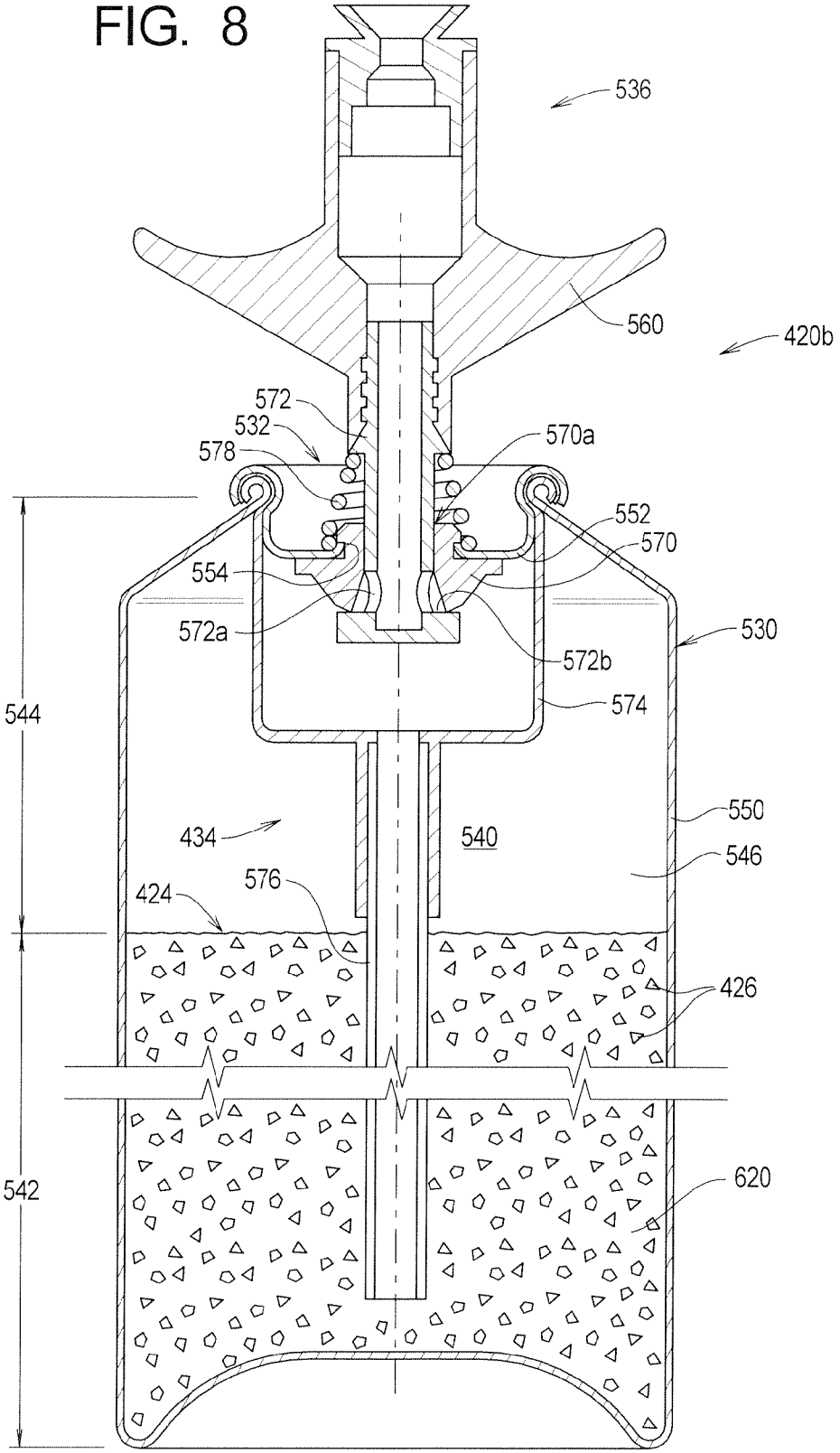
FIG. 8 is a section view of a second embodiment of an aerosol dispensing system containing acoustic texture material incorporating particulate material of the present invention.

Depicted in FIGS. 7 and 8 of the drawing are first and second examples of an aerosol acoustic texture dispensing systems 420*a* and 420*b* constructed in accordance with, and embodying, the principles of the present invention.

A. First Example

Figure 10:
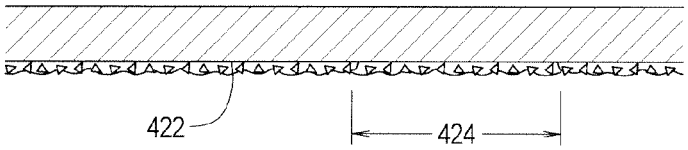
FIG. 10 is a section view of the acoustic texture material after it has been deposited on the surface.
Figure 11:
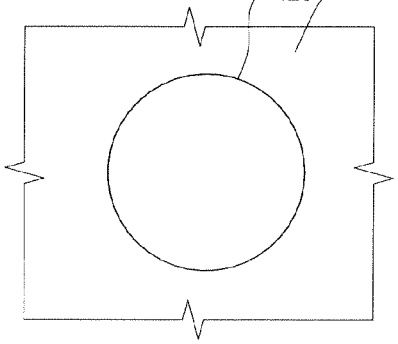
FIGS. 11 and 12 are bottom plan views of the surface before and after the acoustic texture material has been deposited thereon.

Referring now to FIG. 7 of the drawing, depicted at 420*a* therein is a first embodiment of an aerosol system for depositing on a surface 422 (FIGS. 9-12) acoustic texture material 424 incorporating particulate material 426 of the present invention. FIG. 11 illustrates a target portion 428 of the surface 422 on which acoustic texture material 424 is to be deposited.

The example aerosol system 420*a* comprises a container assembly 430, a valve assembly 432, a collection assembly 434, and an outlet assembly 436. The container 430 defines a product chamber 440 in which the acoustic texture material 424 comprising the particulate material 426 is contained. A first portion 442 of the chamber 440 is occupied by the acoustic texture material 424, while a second portion 444 of the chamber 440 is occupied by a pressurized propellant material 446. The example container assembly 430 comprises a can member 450 and a cup member 452.

The valve assembly 432 is mounted in a cup opening 454 defined by the cup member 452 and operates in a closed configuration (shown) and an open configuration. In the open configuration, the valve assembly 432 defines a dispensing passageway that allows fluid communication between the interior and the exterior of the container assembly 430.

The outlet assembly 436 comprises an actuator member 460 that causes acoustic texture material 424 to be dispensed by the system 420 in a fan shaped spray as will be described in further detail below. The actuator member 460 is mounted on the valve assembly 432 such that displacing the actuator member 460 towards the valve assembly 432 places the valve assembly in the open configuration.

The example valve assembly 432 comprises a valve seat 470, a valve stem 472, a valve housing 474, a dip tube 476, and a valve spring 478. The valve seat 470 defines a seat opening 470*a* and is supported by the cup member 452. The valve stem 472 defines a valve stem opening 472*a* and a valve surface 472*b*. The valve stem 472 is supported by the valve seat 470 such that the valve stem moves within the valve stem opening 472*a* between first and second positions, with the first position being shown in FIG. 7.

The valve housing 474 is supported by the valve seat 470 within the product chamber 440. The valve housing 474 further supports the dip tube 476 such that the acoustic texture material 424 within can flow into the valve housing 474 when the can is upright. The valve spring 478 is supported by the valve housing 474 such that the spring 478 biases the valve stem 472 into the first position. The valve stem 472 supports the outlet assembly 436 such that depressing the actuator member 460 towards the cup member 452 forces the valve stem 472 into the second position (not shown) against the force of the valve spring 478.

The valve assembly 432 thus operates in the closed configuration and the open configuration as follows. When no force is applied to the actuator member 460, the valve spring 478 forces the valve surface 472*b* against the valve seat 470 to prevent fluid from flowing through the valve stem opening 472*a*. When a force is applied to the actuator member 460, the valve surface 472*b* is forced away from the valve seat 470 such that fluid can flow from the interior of the valve housing 474 through the valve stem opening 472*a* and thus out of the product chamber 440.

B. Second Example

Referring now to FIG. 8 of the drawing, depicted at 420*b* therein is a first embodiment of an aerosol system that may also be used to deposit the acoustic texture material 424 incorporating particulate material 426 of the present invention on the target portion 428 of the surface 422.

The example aerosol system 420*b* comprises a container assembly 530, a valve assembly 532, a collection assembly 534, and an outlet assembly 536. The container 530 defines a product chamber 540 in which the acoustic texture material 424 comprising the particulate material 426 is contained. A first portion 542 of the chamber 540 is occupied by the acoustic texture material 424, while a second portion 544 of the chamber 540 is occupied by a pressurized propellant material 546. The example container assembly 530 comprises a can member 550 and a cup member 552.

The valve assembly 532 is mounted in a cup opening 554 defined by the cup member 552 and operates in a closed configuration (shown) and an open configuration. In the open configuration, the valve assembly 532 defines a dispensing passageway that allows fluid communication between the interior and the exterior of the container assembly 530.

The outlet assembly 536 comprises an actuator member 560 that causes acoustic texture material 424 to be dispensed by the system 420 in a fan shaped spray as will be described in further detail below. The actuator member 560 is mounted on the valve assembly 532 such that displacing the actuator member 560 towards the valve assembly 532 places the valve assembly in the open configuration.

The example valve assembly 532 comprises a valve seat 570, a valve stem 572, a valve housing 574, a dip tube 576, and a valve spring 578. The valve seat 570 defines a seat opening 570*a* and is supported by the cup member 552. The valve stem 572 defines a valve stem opening 572*a* and a valve surface 572*b*. The valve stem 572 is supported by the valve seat 570 such that the valve stem moves within the valve stem opening 572*a* between first and second positions, with the first position being shown in FIG. 8.

The valve housing 574 is supported by the valve seat 570 within the product chamber 540. The valve housing 574 further supports the dip tube 576 such that the acoustic texture material 424 within can flow into the valve housing 574 when the can is upright. The valve spring 578 is supported by the valve housing 574 such that the spring 578 biases the valve stem 572 into the first position. The valve stem 572 supports the outlet assembly 536 such that depressing the actuator member 560 towards the cup member 552 forces the valve stem 572 into the second position (not shown) against the force of the valve spring 578.

The valve assembly 532 thus operates in the closed configuration and the open configuration as follows. When no force is applied to the actuator member 560, the valve spring 578 forces the valve surface 572*b* against the valve seat 570 to prevent fluid from flowing through the valve stem opening 572*a*. When a force is applied to the actuator member 560, the valve surface 572*b* is forced away from the valve seat 570 such that fluid can flow from the interior of the valve housing 574 through the valve stem opening 572*a* and thus out of the product chamber 540.

C. Method of Use

Turning now to FIGS. 9-12, the use of the aerosol dispensing systems 420*a* and 420*b* will now be described in further detail. These dispensing systems 420*a* and 420*b* are used in the same manner and are both identified by reference character 420 in FIGS. 9-12.

Figure 9:
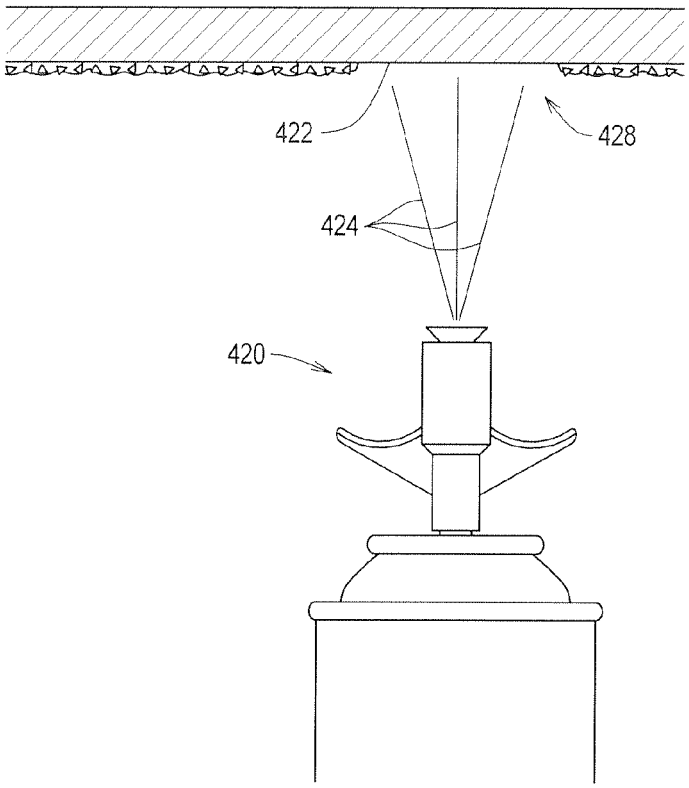
FIG. 9 is an elevation view depicting the use of one or both of the first and second aerosol dispensing systems of FIGS. 7 and 8 being used to deposit acoustic texture material to a surface.
Figure 12:
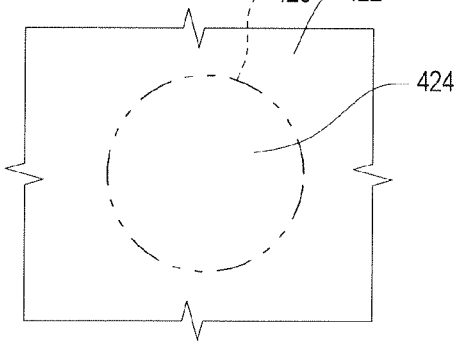

As shown in FIG. 9, the dispensing system 420 deposits a fan-shaped spray of acoustic texture material 424 on the target portion 428 of the surface 422. As shown in FIGS. 10 and 12, the acoustic texture material 424 covers the target portion 428 to match the pre-existing acoustic texture material on the surface 422 surrounding the target portion 428.

Referring for a moment back to FIGS. 7 and 8, it can be seen that, in addition to the particulate material 426, the acoustic texture material comprises a base portion 620 in the form of a flowable liquid. The base portion 620 of the particulate material conventionally comprises a carrier, a filler, and a binder.

In some aerosol systems, the propellant material 446,546 is simply an inert pressurized gas such as air or nitrogen. In other aerosol systems, the propellant material 446,546 is a material, referred to herein as bi-phase propellant material, that exists in both gaseous and liquid phases within the container assembly 430,530. The liquid phase of the propellant material 446,546 forms a part of the base portion 620, while the gaseous phase propellant material 446,546 occupies the pressurized portion 444, 544 of the container assembly 430, 530.

As the acoustic texture material 424 is dispensed, the pressure within the pressurized portion 444,544 of the container assemblies 430,530 drops. Under these conditions, a portion of the bi-phase propellant material 446,546 in the liquid phase gasifies to re-pressurize the pressurized portion 444,544 of the container assembly 430,530. The pressure within the pressurized portion 444,544 is thus under most conditions sufficient to force the acoustic texture material 424 out of the container assembly 430,530 along the dispensing passageway when the valve assembly 432,532 is in the open configuration. The propellant material 446,546 may thus be a pressurized inert gas such as air or nitrogen.

However, the present invention is of particular significance when the propellant material is a bi-phase propellant material such as di-methyl ether (DME) or any one of a number of hydrocarbon propellants such as those available in the industry as A-40 and A-70. The advantage of using bi-phase propellant materials is that the pressure within the pressurized portion 444,544 of the container assembly 430,530 is kept at a relatively constant, relatively low level as the level of acoustic texture material 424 drops. This constant, low level pressure allows the texture material 424 to be dispensed in many small bursts instead of in a few large bursts, as is the case when pressurized inert gases are used as the propellant material 446,546.

Many particulate materials 426 suitable for use in acoustic texture materials are incompatible with bi-phase propellant materials. For example, as described above polystyrene chips are commonly used in acoustic texture materials dispensed using commercial hopper guns. However, polystyrene chips dissolve in the bi-phase propellant materials of which the Applicant is aware.

The Applicant has discovered that urethane foam materials and melamine foam materials may be used as the particulate material 426 with bi-phase propellant materials such as DME and hydrocarbon propellants such as A-40 and A-70. Melamine foam materials in particular are easily chopped up using conventional material processors (e.g., a food blender) into irregular shapes that match the appearance and function of polystyrene chips. Melamine foam materials are already commonly used in building applications and have desirable fire retardant, thermal, and acoustic properties.

To manufacture the acoustic texture material 424, the base portion 620 may be the same as a conventional base used in commercially available acoustic texture materials. Instead of polystyrene chips, however, urethane and/or melamine foam is chopped up into particles of an appropriate size and use as the particulate. In addition, a bi-phase propellant material is used to form part of the carrier portion of the base portion 620.

The Applicant has thus determined that a conventional base portion using melamine foam chips and DME as a propellant is commercially practical and obtains acceptable aesthetic and functional results. Appropriate adjustments in the liquids used as the carrier in a conventional acoustic texture material formulation may be required to obtain a desired consistency of the acoustic texture material 424 as it is deposited on the surface 422.

Various modifications can be made to the embodiments described above without departing from the principles of the present invention.

What is claimed is:

1. A system for forming an acoustic texture coating on a surface, comprising:

an aerosol dispenser;

a liquid portion of a propellant material;

a gas portion of the propellant material;

a base material;

a plurality of discrete particles of at least one of urethane foam and melamine foam, where the discrete particles define a physical structure; wherein the liquid portion of the propellant material, the gas portion of the propellant material, the base material, and the plurality of discrete particles are disposed within the aerosol dispenser;

the propellant material does not alter the physical structure of the discrete particles when combined within the aerosol dispenser; and when the aerosol dispenser is operated, the base material and the discrete particles are deposited on an uncoated portion of the surface such that the base material dries to adhere the discrete particles to the uncoated portion of the surface.

2. A combination system as recited in claim 1, in which the propellant material is at least one of DME, A-40, and A-70.

3. A combination system as recited in claim 1, in which the propellant material is a hydrocarbon propellant material.

4. A combination system as recited in claim 1, in which a physical structure of the discrete particles adhered to the uncoated portion of the surface substantially matches a physical structure of a coated portion of the substrate.

5. A method of forming an acoustic texture coating on a surface, comprising the steps of:

providing an aerosol dispenser;

arranging a liquid portion of a propellant material within the aerosol dispenser;

arranging a gas portion of the propellant material within the aerosol dispenser;

arranging a base material within the aerosol dispenser;

arranging a plurality of discrete particles of at least one of urethane foam and melamine foam within the aerosol dispenser, where the discrete particles define a physical structure, and the propellant material does not alter the physical structure of the discrete particles when the propellant material and the discrete particles are arranged within the aerosol dispenser; and operating the aerosol dispenser to deposit the base material and the discrete particles on the surface; and allowing the base material to dry to adhere the discrete particles to the surface.

6. A combination method as recited in claim 5, in which the propellant material is at least one of DME, A-40, and A-70.

7. A combination method as recited in claim 5, in which the propellant material is a hydrocarbon propellant material.

8. A combination method as recited in claim 5, in which a physical structure of the discrete particles adhered to the uncoated portion of the surface substantially matches a physical structure of a coated portion of the substrate.

* * * * *